US005781998A

United States Patent [19]

Stamper

[11] Patent Number: 5,781,998

[45] Date of Patent: Jul. 21, 1998

[54] SHEATH STYLE FOLDING KNIFE

[76] Inventor: James D. Stamper, P.O. Box 62, Grantham, N.H. 03753

[21] Appl. No.: 408,594

[22] Filed: Mar. 21, 1995

Related U.S. Application Data

[63] Continuation-in-part of Ser. No. 172,831, Dec. 23, 1993, abandoned.

[51] Int. Cl.[6] ..... B26B 1/02; B26B 1/10

[52] U.S. Cl. ..... 30/139; 30/153; 30/155; 30/161

[58] Field of Search ..... 30/138, 139, 153, 30/155, 157, 158, 159, 160, 161, 329, 330, 331; 7/120

[56] References Cited

U.S. PATENT DOCUMENTS

| | | | |
|---|---|---|---|
| 684,016 | 10/1901 | Weidknecht | 30/161 |
| 728,416 | 5/1903 | Rowland | 30/153 |
| 770,118 | 9/1904 | Rowland | 30/153 |
| 847,206 | 3/1907 | Saunderson | 30/153 |
| 924,070 | 6/1909 | Holman | 30/161 |
| 942,342 | 12/1909 | McNally | 30/153 X |
| 1,270,727 | 6/1918 | Hanstein | 30/153 |
| 2,989,100 | 6/1961 | Burdis et al. | 30/153 X |
| 4,124,939 | 11/1978 | Onoue | 30/161 |
| 4,730,393 | 3/1988 | Coburn | 30/153 |
| 4,811,486 | 3/1989 | Cunningham | 30/158 X |
| 5,437,101 | 8/1995 | Collins | 30/153 |
| 5,647,129 | 7/1997 | Stamper | 30/139 |

*Primary Examiner*—Clark F. Dexter
*Attorney, Agent, or Firm*—Michael J. Weins

[57] ABSTRACT

A folding knife is provided which has a blade, a main handle and a tail handle. The tail handle is pivotably engaged to the main handle. When the knife is in a work configuration, a free end of the tail handle is swung to engage a blade end of the main handle and, together with the main handle, the tail handle forms a grip from which the blade extends. Both the main handle and the tail handle have grooves, such that when the tail handle is swung away from the main handle into an open position, the handles together form a sheath for the blade. With the main handle and the tail handle so configured, the blade of the folding knife can be longer than the grip and yet still be sheathed when the blade is swung into the sheath formed by the main handle and the tail handle for storage. The knife preferably has a tip encasing assembly attached to the tail handle which prevents the blade from being accidentally disengaged from the sheath. Either a grooved wheel or a block with a tip engaging notch can be used as the tip encasing assembly. When a grooved wheel is employed, it is preferred that the wheel be a sharpening stone.

19 Claims, 7 Drawing Sheets

SHEATH STYLE FOLDING KNIFE

This is a continuation-in-part of application Ser. No. 08/172,831 filed on Dec. 23, 1993, now abandoned.

FIELD OF THE INVENTION

The present invention is directed to a folding knife having the appearance of a sheath knife and, more particularly, to a folding knife which has a blade which folds into a two part handle.

BACKGROUND OF THE INVENTION

There have been a variety of folding knives having the appearance of a sheath knife which have the blade sheathed by the handle when not in use.

An early patent, teaching a folding knife which has its blade sheathed by the handle, is U.S. Pat. No. 684,016. The blade of this knife is sheathed in the handle when closed. However, the '016 patent does not provide a guard, nor does it teach, disclose, or claim a knife where the blade length is greater than the handle length.

U.S. Pat. No. 728,416 teaches a folding knife which has a collapsible guard and a handle with a handle extender which is pivotably mounted to the handle that partially folds into the grip. When the handle extender is opened, the blade folds into the handle and the handle extender provides a sheath for the blade. The design of the '416 patent overcomes, in part, the limitations of the '016 patent by providing a guard and a handle design which will accommodate a blade slightly longer than the length of the grip. However, since the pivot point for the handle extender is centrally located in the handle, the increase in the length provided by the handle extender is limited. Furthermore, the guard design results in additional moving parts. The knife of the '416 patent will be difficult to fabricate and is not well suited to knives where the blade is substantially longer than the handle. Another limitation of the design of the '416 patent is that the handle extender protrudes from the grip resulting in an irregular gripping surface. With the design of the '416 patent, the point and cutting surface of the blade are subject to being accidently exposed since the handle extender is maintained in the open position by a back spring and there is no locking mechanism to affirmatively lock the blade relative to the handle and handle extender.

U.S. Pat. No. 770,118 has overcome the problem of the limited blade length which can be sheathed by the handle by providing an extender which is pivotably attached to the butt end of the handle. However, the design employs folded sheet stock and the resulting knife will have limited rigidity. Furthermore, while there is a catch to maintain the two handle sections in the open position, there are no means provided to maintain the knife blade in the sheath created by handle and handle extender.

U.S. Pat. No. 924,070 has in part overcome the above safety problem of the '416 patent by providing a loop which swings around the tip of the blade; however, this loop must be engaged with the blade by the user and may be dislodged during storage. The design of the '070 patent also suffers from the limitations of the '416 patent since it provides only a marginal increase in the length of the blade that can be stored and has a protrusion in a grip region of the handle. Furthermore, the design of the '070 patent does not readily support a guard.

Thus, there is a need for a folding knife with the appearance of a sheath knife which has a large blade, a comfortable grip, and a self activating safety to prevent accidental opening.

OBJECTS OF THE INVENTION

It is an object of the invention to provide a folding knife having a blade which is longer than the length of the handle when the knife is in a work configuration.

It is another object of the invention to provide a folding knife having a safety means to prevent accidental opening of the knife.

It is yet another object of the invention to provide a folding knife with a guard.

It is still a further object of the invention to provide a folding knife where the blade is stored in a slot which closely follows the contour of the blade.

It is still another object of the invention to provide a blade which is sheathed in the handle where the blade's edge is protected from dulling during storage.

It is yet another object of the invention to provide a folding knife having a tip restrainer which also serves as a sharpener for the blade of the folding knife.

A further object of the invention is to provide a folding knife which has a tip sharpening element which can be utilized for sharpening other blades.

These and other objects will become apparent from the following description, drawings, and claims.

SUMMARY OF THE INVENTION

The present invention is a folding knife having a handle and a blade. The folding knife has a storage configuration where the handle serves as a sheath and a work configuration where the knife has the appearance of a sheath knife. The handle of the present invention has two parts, a main handle and a tail handle which are pivotably connected. The main handle and the tail handle rotate between a closed position, where they form a grip, and an open position, where they form a sheath for the blade. When the main handle and the tail handle form the grip, the folding knife is in the work configuration, and when the main handle and the tail handle form the sheath, the folding knife is in the storage configuration. The blade of the folding knife of the present invention is greater in length than the grip formed by the main handle and the tail handle.

The main handle terminates in a butt end and blade end. The blade is pivotably mounted in the blade end.

The main handle has a main groove which extends along the main handle passing through the butt end and the blade end.

The tail handle has a butt engaging end pivotably connected to the butt end of the main handle and has a free end. The free end swingably engages the blade end of the main handle. In one preferred embodiment, the blade end of the main handle and the free end of the tail handle are configured to form a guard when the knife is in the work configuration.

The tail handle has a tail groove which extends along the tail handle and passes through the butt engaging end. The main groove and the tail groove are co-planar. The tail handle pivots about the butt end of the main handle between the closed position, where, in combination with the main handle, the tail handle forms the grip for the knife when the knife is in the work configuration, and the open position, where the main groove and the tail groove align to provide the sheath into which the blade of the knife folds when the knife is in its storage configuration.

The blade has a tang and a blade tip. The tang extends into the main groove and is pivotably mounted therein at the blade end of the main handle. When the tail handle is rotated to the open position with respect to the main handle, the main groove and the tail groove will store the blade, which will be positioned in the main groove and the tail groove such that the blade tip resides in the tail groove.

To assure that the folding knife remains in the storage configuration until positive actions are taken to release the blade from the storage configuration, means for locking the tail handle in the open position are provided. In one embodiment of the present invention, the means for locking the tail handle in the open position include means for biasing the tail handle to pivot towards the main handle in combination with a tip encasing assembly. One embodiment of the tip encasing assembly is a block with a tip engaging notch. The tip encasing assembly is positioned to overlap the blade tip when the folding knife is in its storage configuration.

In one embodiment, a coil spring is employed as the means for biasing the tail handle and urging it to move toward the closed position with respect to the main handle. The coil spring, in combination with the tip engaging block mounted in the tail groove, will lock the blade in the storage position. When the tip engaging block overlaps the blade tip, the blade will be maintained in the tail groove and the main groove when the folding knife is in the storage configuration.

In another preferred embodiment of the present invention a grooved wheel is rotatably mounted on the tail handle and positioned such that the tail groove and the grooved wheel, in combination, serve to encase the blade tip rather than a block with a tip engaging notch.

In another preferred embodiment, a cam and a spring loaded cam follower are employed as means for locking the tail handle in the open position. The cam has a cam surface which compresses a spring as the tail handle is opened. The cam surface is provided with a cam notch so positioned that the tail handle will lock in the open position when the cam follower engages the cam notch.

The tail handle can have the cam mounted thereon and a leaf spring, which has a protrusion thereon serving as a cam follower, can be mounted on the main handle. Alternatively, the cam surface can be made as part of the main handle and the leaf spring having the protrusion can be mounted on the tail handle.

The cam follower locks the tail handle in the open position when the cam follower is positioned in the cam notch. If the knife has a leaf spring provided to engage an upper tang notch to stabilize the blade in the open position, the leaf spring can be used as the spring for the cam follower. It should also be appreciated that the cam follower could be affixed to one of the handle components and the cam surface could be spring loaded.

When the cam, in combination with the cam follower, is used as a locking means, it is preferably augmented with the tip encasing assembly such as a tip engaging block having a blade tip notch. When the tip engaging block is employed, three positions of the tail handle relative to the main handle are critical to its effective operation. When the folding knife is in its work configuration the tail handle is rotated toward the main handle to form a grip and the handle is in the closed position and the cam follower will not be engaged with the cam surface. When the tail handle is swung away from the main handle to a blade accepting position, the cam surface has a stop against which the cam follower abuts, defining the maximum rotation of the tail handle with respect to the main handle. In the blade accepting position, the blade tip can be rotated into the tip encasing assembly of the tail handle and past the tip engaging block. When the blade tip is positioned in the tail handle and has been rotated past the tip engaging block of the tail handle, and the tail handle is released from the blade accepting position, the cam surface urges the tail handle to the open position where the cam follower engages the cam notch and locks the tail handle in the storage configuration with the blade tip residing in the tip encasing assembly.

In an alternative embodiment of the present invention, rather than providing a cam and cam follower mechanism as a biasing means, a leaf spring can be mounted in the main handle and a tail spring stop mounted on the tail handle. The tail spring stop is positioned to rotatably engage the leaf spring as the tail handle is opened thereby urging the tail handle toward the main handle.

To increase the rigidity of the grip formed when the main handle and the tail handle are in the closed position, it is preferred that the tail handle and main handle have interlocking surfaces. It is further preferred that the blade end of the main handle and the free end of the tail handle have interlocking surfaces. Such surfaces can be provided by the use of tabs and tab receiving recesses.

In another preferred embodiment of the present invention the free end of the tail handle has a tang block which engages a lower tang notch to further stabilize the blade when the folding knife is in the work configuration.

BRIEF DESCRIPTION OF THE FIGURES

The tail handle is shown in its open position with respect to the main handle. In the open position the cam follower is engaged with the cam notch of the cam surface. The blade has a blade tip and a tang. The blade rotates about an axis in the tang such that the blade tip can be positioned in a blade tip notch in a tip engaging block. Having the blade tip so positioned assures that when the folding knife is in its storage configuration, the blade is locked in the sheath formed by the tail handle and the main handle. The tip engaging block assures that the blade will remain sheathed in the event that the folding knife is dropped or knocked such that the cam follower is disengaged from the cam notch. FIG. 8 also shows, in phantom lines, the tail handle rotated beyond its open position with respect to the main handle. This position shown in phantom is the blade accepting position where the blade tip can be swung past the tip engaging block and into the main groove and the tail groove. The cam surface is configured to urge the tail handle from the blade accepting position to the open position where the main handle and the tail handle serve as the sheath for the blade. The embodiment of FIG. 8 also illustrates guard tabs which assist in stabilizing the main handle with respect to the tail handle in the closed position where the handles serve as the grip for the knife while in its work configuration.

BEST MODE FOR CARRYING THE INVENTION INTO PRACTICE

Figure 1:
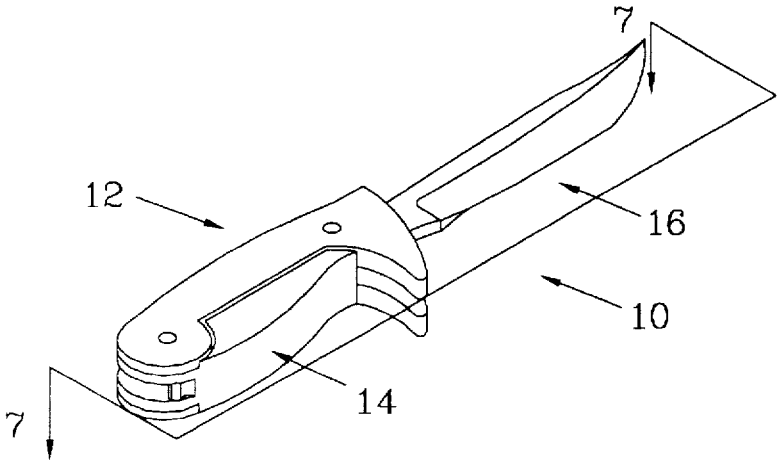
FIG. 1 is an isometric view of one embodiment of a folding knife. In this embodiment, a main handle is employed with a blade end contoured to form a guard. The folding knife, as illustrated, has the appearance of a sheath knife and is in a work configuration. This embodiment, as do all the embodiments of the present invention, has a main handle which is pivotably connected to a tail handle and a blade which is pivotably connected to the blade end of the main handle.
Figure 2:
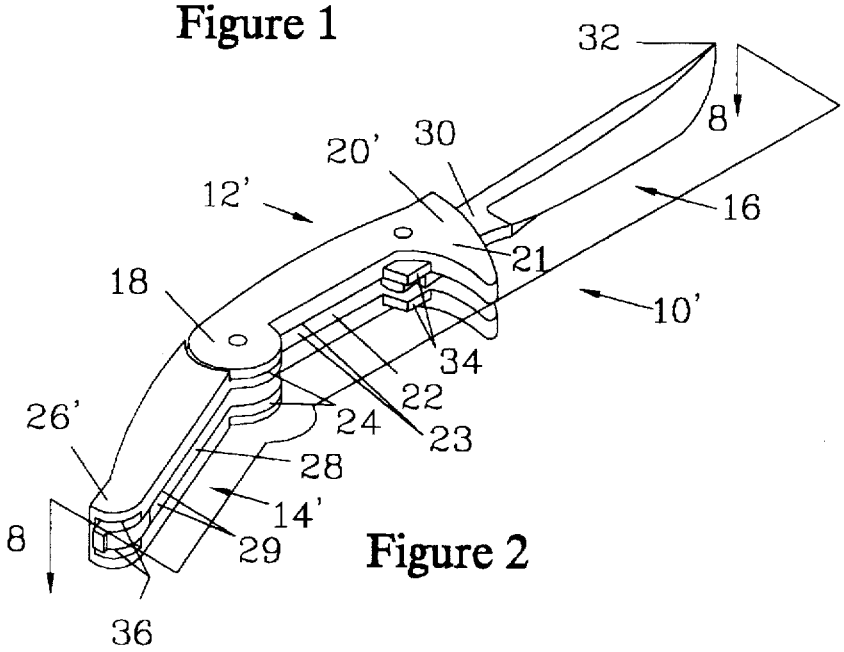
FIG. 2 is an isometric view of another embodiment similar to the folding knife of FIG. 1. The tail handle is illustrated in an open position where the main handle and tail handle serve as a sheath for encasing the blade. The embodiment of FIG. 2 employs a tab attached to the main handle and tab receiving recesses in a free end of the tail handle to increase the stability of the grip.
Figure 3:
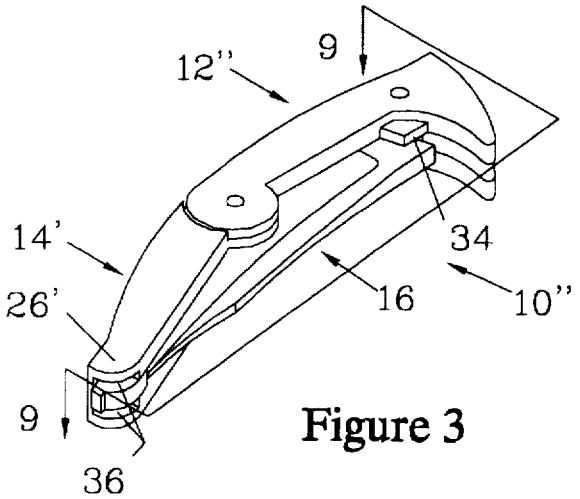
FIG. 3 is an isometric view of another embodiment similar to the folding knives of FIGS. 1 and 2. The folding knife is in a storage configuration where the tail handle is in an open position and the blade is stored in a main groove in the main handle and a tail groove in the tail handle. A tip engaging block is provided which overlaps the blade tip. The embodiment of FIG. 3 employs a spacer inside the main groove.
Figure 4:
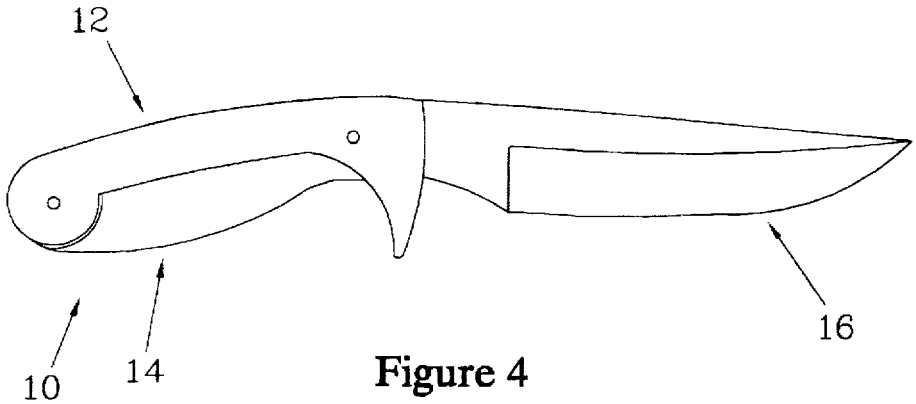
FIGS. 4 through 6 are elevation views of the embodiment illustrated in FIG. 1. In this embodiment, when the tail handle is in its closed position with respect to its main handle, the resulting grip is stabilized by contact between the main handle and the tail handle and by the interlocking character of the pivotable connection between a butt end of the main handle and a butt engaging end of the tail handle. This embodiment has a tip engaging block which, when the tail handle is in the closed position, engages a main groove of the main handle further stabilizing the grip.

FIGS. 1 through 3 provide isometric views of three closely related embodiments of the present invention. All of these embodiments have the common elements illustrated in FIG. 1. A folding knife 10 shown in FIG. 1 has three principal parts common to all embodiments of the present invention: a main handle 12, a tail handle 14 pivotably engaged with the main handle 12, and a blade 16 pivotably engaged with the main handle 12. The knives 10 of FIGS. 1, 2 and 3 have tail handles 14 which rotate between an open position, shown in FIGS. 5 and 6 and a closed position, such as shown in FIGS. 1 and 4. In the closed position shown in FIG. 1, the tail handle 14 mates with the main handle 12 and forms a grip for the folding knife 10. When the handles (12 and 14) are in the closed position, the folding knife 10 is said to be in its work configuration.

FIG. 2 illustrates an embodiment of the present invention similar to the embodiment shown in FIG. 1. A knife 10' is shown where the tail handle 14' has been pivoted to the open position while the blade 16 of the folding knife 10' remains in the work configuration. The main handle 12' terminates in a butt end 18 and a blade end 20'. In this embodiment, the blade end 20' is contoured to provide a guard 21. The main handle 12' has a main groove 22 which extends along the main handle 12' passing through the butt end 18 and the blade end 20'.

The tail handle 14' has a butt engaging end 24, pivotably attached to the butt end 18 of the main handle 12', and has a free end 26', which is contoured to swingably engage the blade end 20' of the main handle 12'. The tail handle 14' has a tail groove 28 which extends along the tail handle 14' and passes through the butt engaging end 24. The main groove 22 and the tail groove 28 are delimited by side surfaces 23 and 29, which are co-planar. The tail handle 14' pivots between the closed position and the open position (shown in FIG. 2).

When the tail handle 14' is in the closed position with respect to the main handle 12', the free end 26' of the tail handle 14' engages the blade end 20' of the main handle 12'. When the tail handle 14' is in the closed position, the tail handle 14', in combination with the main handle 12', forms the grip for the folding knife 10' when it is in its work configuration. Alternatively, when the tail handle 14' is in the open position with respect to the main handle 12', the main groove 22 and the tail groove 28 provide a sheath for the blade 16.

The blade 16 has a tang 30 and a blade tip 32. The tang 30 resides in the main groove 22 and is pivotably mounted to the blade end 20' of the main handle 12'. When the tail handle 14' is in the open position with respect to the main handle 12', the blade 16 can be stored in the main groove 22 and the tail groove 28, and will be positioned such that the blade tip 32 resides in the tail groove 28. The embodiment of FIG. 2 differs from the embodiment of FIG. 1 in that tabs 34 are provided to the blade end 20' of the main handle 12' and tab receiving recesses 36 are provided in the tail handle 14' to further stabilize the main handle 12' with respect to the tail handle 14' when the tail handle 14' is in the closed position where the main handle 12' and the tail handle 14' form the grip.

FIG. 3 illustrates another related embodiment, a folding knife 10" where the tail handle 14' has been rotated to the open position with respect to the main handle 12" and the blade 16 is positioned such that the main handle 12" and the tail handle 14' form the sheath for the blade 16. When the blade 16 is stored in the sheath formed by the main handle 12" and the tail handle 14', the folding knife 10" is in its storage configuration. This embodiment employs the tabs 34 and the tab receiving recesses 36.

Figure 5:
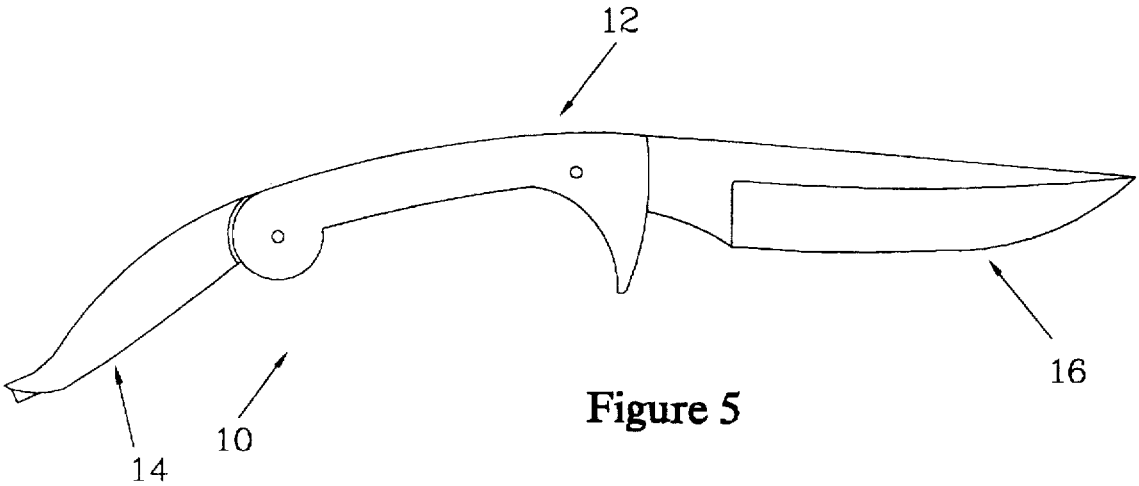
Figure 6:
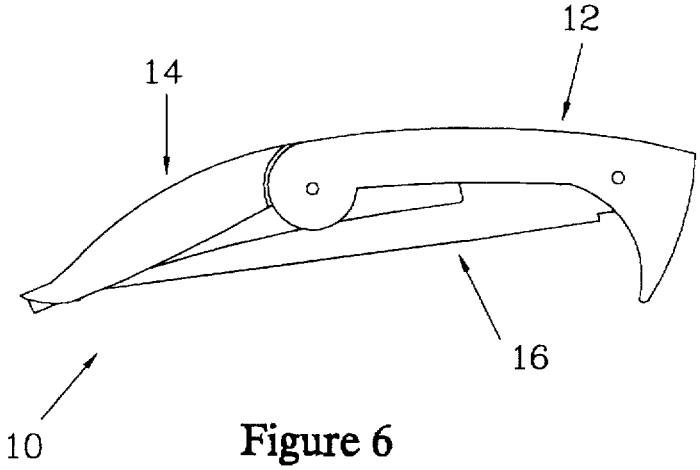

FIGS. 4 through 6 illustrate the folding knife 10 of FIG. 1 in elevation view and further illustrate the relative position and size of the main handle 12, the tail handle 14, and the blade 16. FIG. 4 illustrates the folding knife 10 of FIG. 1 in the work configuration. FIG. 5 illustrates the folding knife 10 of FIG. 1 with the tail handle 14 in the open position but before the blade 16 has been pivoted into the storage configuration. FIG. 6 illustrates the folding knife 10 in the storage configuration.

Figure 7:
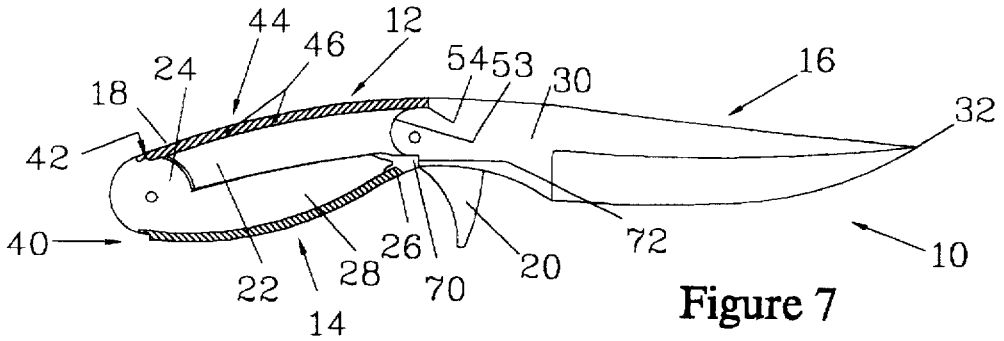
FIG. 7 is a section 7—7 of the folding knife illustrated in FIG. 1. In this embodiment, a cam having a cam surface is attached to the tail handle. A cam follower, which slidably engages the cam surface, is attached to the main handle with a leaf spring. The cam surface and the spring loaded cam follower are employed as a means for securing the tail handle in the open position. The cam surface is an integral part of the tail handle and a cam notch is provided in the cam surface where the cam follower will reside when the tail handle is in the open position.

FIG. 7 is a section 7—7 of FIG. 1 which illustrates the relative position and the connections among the blade 16, the tail handle 14 and the main handle 12 when the folding knife 10 is in the work configuration. As can be seen by viewing FIG. 7, the blade 16 of the folding knife 10 is longer than the length of the grip formed by the tail handle 14, and the main handle 12 when the tail handle 14 is rotated to the closed position with respect to the main handle 12.

In the embodiment of FIG. 1 which is illustrated in sectional view in FIG. 7, a means for locking the tail handle 14 in the open position is a cam 40, which in combination with a cam follower 42, maintains the tail handle 14 in the open position illustrated in FIGS. 5 and 6. The cam 40 is attached to the butt engaging end 24 of the tail handle 14. The cam follower 42 is spring loaded by a leaf spring 44 which attaches to the main handle 12 with rivets 46.

Figure 8:
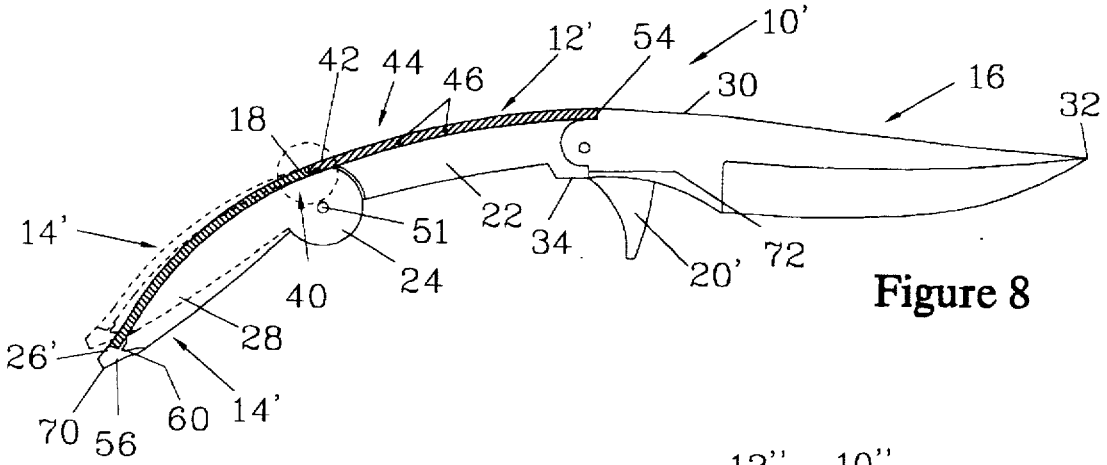
FIG. 8 is a section 8—8 of FIG. 2 for the embodiment of the folding knife illustrated in FIG. 2.
Figure 10:
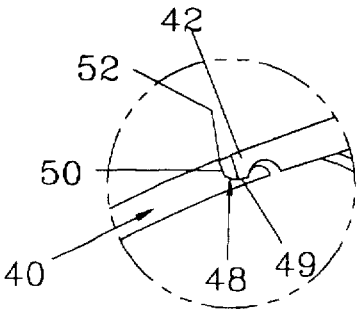
FIG. 10 is an enlargement of the encircled region of FIG. 8.

FIG. 10 is an enlargement of the encircled region of FIG. 8 showing details of the cam follower 42 and the cam 40, which has a cam surface 48 and a cam notch 49. The cam surface 48 engages the cam follower 42 as the tail handle 14' is pivoted about the main handle 12' towards the open position illustrated in FIG. 8. When the cam follower 42 seats in the cam notch 49, the tail handle 14' will be maintained in the open position.

The cam surface 48 extends beyond the cam notch 49. An inclined surface 50 of the cam surface 48 is configured such that as the cam follower 42 moves along the extended portion of the cam surface 48, the tail handle 14' will be biased toward the open position illustrated in FIG. 8. However, the tail handle 14' can be urged past the open position to the blade accepting position (shown in phantom) by rotating the tail handle 14' about a pivot axis 51 such that the cam follower 42 lifts out of the cam notch 49. This rotation will urge the cam follower 42 along the inclined surface 50 of the cam surface 48. This inclined surface 50 increases the strain in the leaf spring 44 as the cam follower 42 advances on the inclined surface 50 until it abuts a stop surface 52. Moving along the inclined surface 50 will raise the leaf spring 44 which will urge the tail handle 14' to rotate from the blade accepting position back to the open position.

The leaf spring 44, employed in the embodiments shown in FIGS. 1 through 9, performs a dual function. In addition to spring loading the cam follower 42, the leaf spring 44 follows the contour of a tang end 53 of the tang 30. The contour of the tang end 53 is so configured to urge the blade 16 to snap into the work configuration when the leaf spring 44 engages an upper tang notch 54 in the tang 30, stabilizing the blade 16 in the work configuration as is illustrated in FIG. 7.

Figure 9:
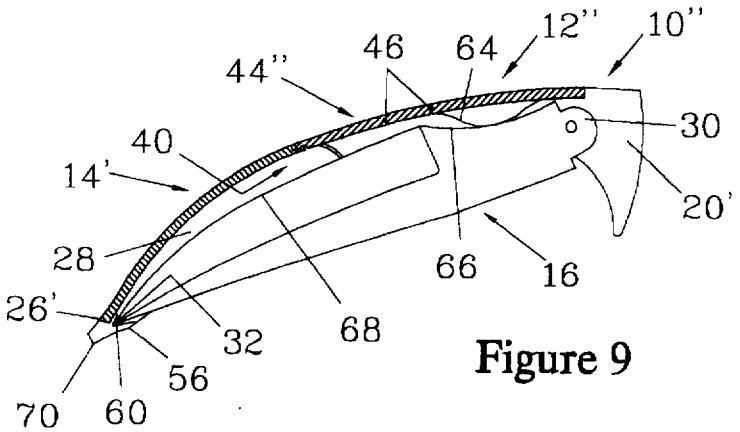
FIG. 9 is a cross section 9—9 of FIG. 3 for a similar embodiment of the folding knife illustrated in FIG. 8. The blade is shown in the storage configuration. In this embodiment, when the folding knife is in the storage configuration, the knife blade is maintained in position by the tip engaging block which resides in the tail groove. The blade is pivoted into the storage position by rotating the tail handle until the blade tip passes by the tip engaging block. This embodiment differs from the embodiment of FIG. 8 in that a spacer, attached to the leaf spring, is employed to stabilize the blade in the storage configuration by engaging a spacer engaging surface on the tang. The spacer assures that the blade will not be dulled by contact with the main handle or the tail handle.

It is preferred, to assure that the blade 16 will not accidentally be released from the storage configuration such as illustrated in FIG. 9, that there be provided a tip encasing assembly. In the embodiment of FIG. 9, the tip encasing assembly is a tip engaging block 56 with a blade tip notch 60. The blade tip notch 60 in the tip engaging block 56 is contoured to enclose the blade tip 32 when the blade 16 is in the storage configuration. The tip engaging block 56 is positioned to surround the blade tip 32 when the blade 16 is positioned in the tail groove 28. In order to release the blade 16 from the storage configuration, the cam surface 48 is configured such that the cam follower 42 can be rotated beyond the cam notch 49 and continue along the inclined surface 50 of the cam surface 48, as illustrated by the phantom image of the tail handle 14' in FIG. 8. With the tail handle 14' so positioned, the blade tip 32 can clear the blade tip notch 60 of the tip engaging block 56, thereby allowing it to be swung into its work configuration shown in FIG. 7. The phantom image of tail handle 14' is at a position of maximum rotation with respect to the main handle 12' with its rotation being limited by the stop surface 52 which, when engaged by the cam follower 42, defines the position of maximum rotation of the tail handle 14' with respect to the main handle 12'.

The embodiment shown in FIG. 9 differs from the embodiment of FIG. 8 in that a spacer 64 is provided as part of the leaf spring 44" in the main handle 12". As is shown in FIG. 9, when the blade 16 is in its storage configuration, a spacer engaging surface 66 of the tang 30 engages the spacer 64 and protects a cutting edge 68 of the blade 16 from engaging the main handle 12" or the tail handle 14', preventing dulling of the cutting edge 68.

As discussed earlier, to increase the stability of the grip formed by the main handle 12' and the tail handle 14', it is preferred that the tail handle 14' and the main handle 12' have interlocking regions. The embodiments of FIGS. 2, 3, 8 and 9 illustrate embodiments which have tabs 34 which serve as interlocking regions. The interlocking regions are provided by the tabs 34 extending from the blade end 20' and the tab receiving recesses 36 (best shown in FIGS. 2 and 3) in the free end 26'. It should be appreciated that the location of the tabs 34 and the tab receiving recesses 36 could be interchanged.

To further stabilize the blade 16 in the work configuration, the free end 26, 26' is fitted with a tang block 70 that engages a lower tang notch 72 on the blade 16, and, in combination with the leaf spring 44, which engages the upper tang notch 54, serves to stabilize the blade 16 in the work configuration as illustrated for the embodiment of FIG. 7. In the embodiment illustrated in FIG. 7, which does not employ tabs which extend from the blade end 20 of the main handle 12, the tang block 70 engages the main groove 22 and stabilizes the tail handle 14 with respect to the main handle 12. Similarly, the tang block 70 is employed with the embodiment of FIG. 8, and also engages the lower tang notch 72, and, in combination with the leaf spring 44, which engages the upper tang notch 54, serves to stabilize the blade 16 in the work configuration.

Figure 11:
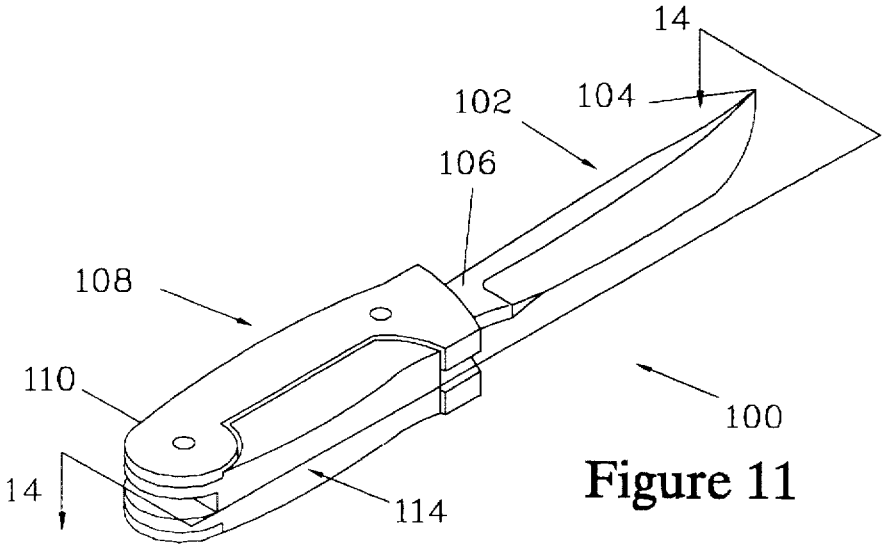
FIG. 11 is an isometric view of a guardless embodiment of a folding knife of the present invention illustrating the major components of the folding knife: a main handle, a tail handle, and a blade. The view illustrates the folding knife in a work configuration, where it has the appearance of a guardless sheath knife. The folding knife of this embodiment employs a spring in the main handle to maintain the main handle and the tail handle in the closed position.
Figure 12:
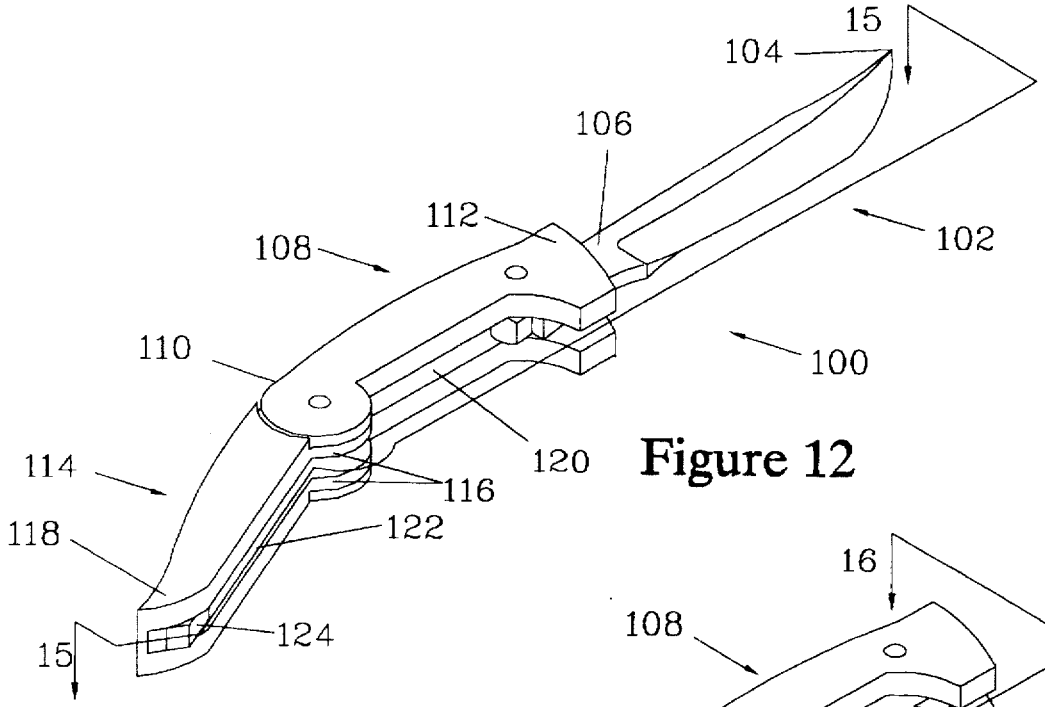
FIG. 12 is an isometric view of the folding knife of FIG. 11 where the tail handle is illustrated in an open position. With the tail handle so disposed the main handle and the tail handle provide a sheath for the blade when the blade is folded into the main handle and the tail handle.
Figure 13:
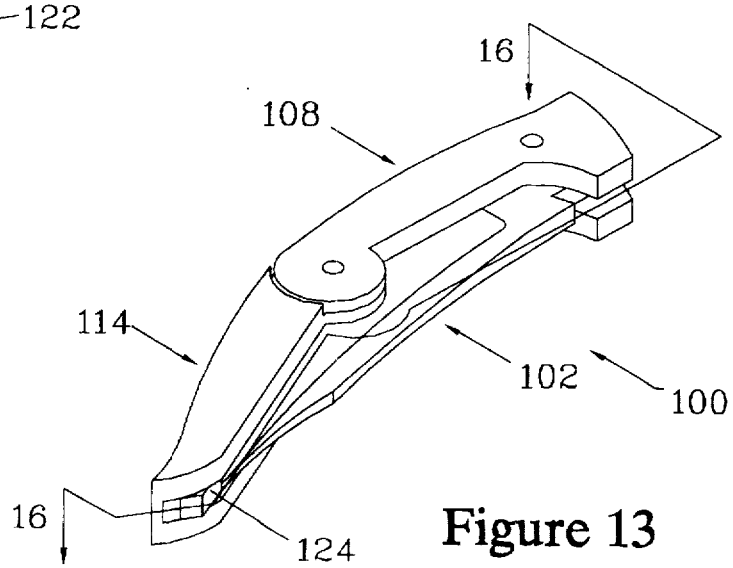
FIG. 13 is an isometric view of the folding knife illustrated in FIGS. 11 and 12 illustrating the folding knife in the storage configuration where the blade is sheathed by the main handle and the tail handle.

FIGS. 11 through 18 are selected views of another embodiment of the present invention. This embodiment is similar to earlier presented embodiments; however, it differs in two principle features. In this embodiment, the blade end of the main handle is contoured to be guardless and a coil spring is employed to bias the tail handle toward the closed position with respect to the main handle. FIGS. 11 through 13 are isometric views of a folding knife 100 which is guardless. The folding knife 100 has a blade 102, terminating in a blade tip 104 and a tang 106.

The tang 106 pivotably engages a main handle 108 which terminates in a butt end 110 and a blade end 112, to which the tang 106 is pivotably attached. A tail handle 114 has a butt engaging end 116, pivotably engaging the butt end 110 of the main handle 108, and a free end 118, which is contoured to mate with the blade end 112 of the main handle 108. FIG. 11 illustrates the folding knife 100 in a work configuration where the tail handle 114 is in a closed position with respect to the main handle 108, and the combination of the main handle 108 and the tail handle 114 forms a grip for the folding knife 100 when in its work configuration.

FIG. 12 illustrates the tail handle 114 in an open position relative to the main handle 108, showing a main groove 120 and a tail groove 122. The main groove 120 traverses the main handle 108 and passes through the butt end 110 and the blade end 112 of the main handle 108. The tail groove 122 traverses the tail handle 114 passing through the butt engaging end 116 and terminating in a tip engaging block 124.

FIG. 13 illustrates the folding knife 100 of FIGS. 11 and 12 with the blade 102 engaging the main groove 120 and the tail groove 122, with the blade 102 so positioned that the folding knife 100 is in a storage configuration. In the storage configuration, the tip engaging block 124 overlaps the blade tip 104 positively holding the blade 102 in the storage configuration.

Figure 14:
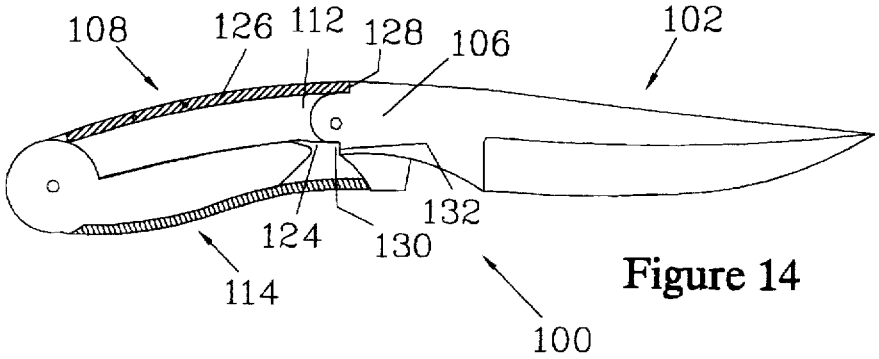
FIG. 14 is a section 14—14 of FIG. 11 illustrating the relative positions of the blade, the main handle and the tail handle in the work configuration.
Figure 15:
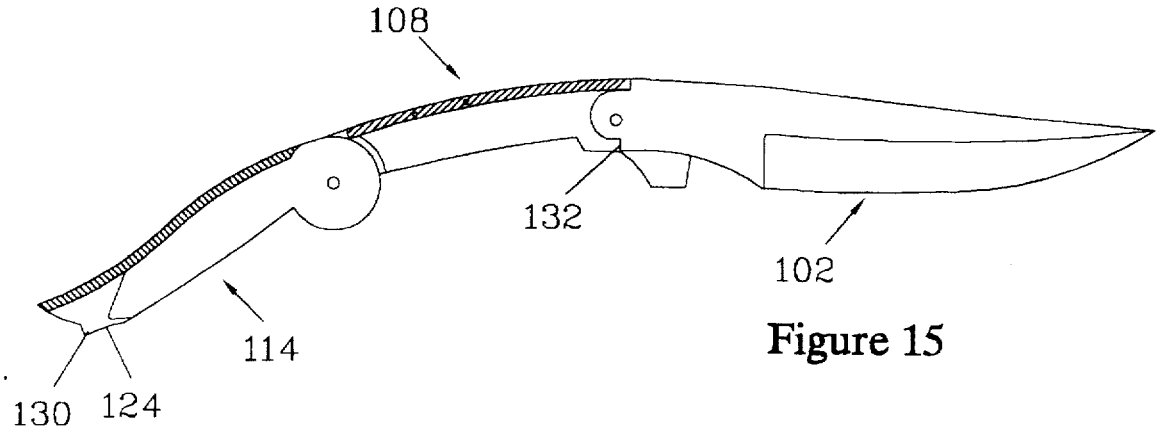
FIG. 15 is a section 15—15 of FIG. 12 illustrating the relative positions of the blade, the main handle and the tail handle in the open position.

FIG. 14 is a section 14—14 of FIG. 11 and provides additional details of the structure of the embodiment illustrated in FIGS. 11 through 13. The main handle 108 is fitted with a leaf spring 126 which rides on the tang 106, which is pivotably mounted to the blade end 112 of the main handle 108. When the blade 102 is in the work configuration, the leaf spring 126 engages an upper tang notch 128, stabilizing the blade 102 in the work configuration, even when the tail handle 114 is moved to the open position as illustrated in FIG. 15. A tang block 130 extends from the tip engaging block 124, and is configured to engage a lower tang notch 132 to further stabilize the blade 102, locking the blade 102 in the work configuration when the tail handle 114 is in the closed position with respect to the main handle 108 and the folding knife 100 is in the work configuration.

FIG. 15 is the section 15—15 of FIG. 12 where the tail handle 114 is in the open position with respect to the main handle 108.

Figure 16:
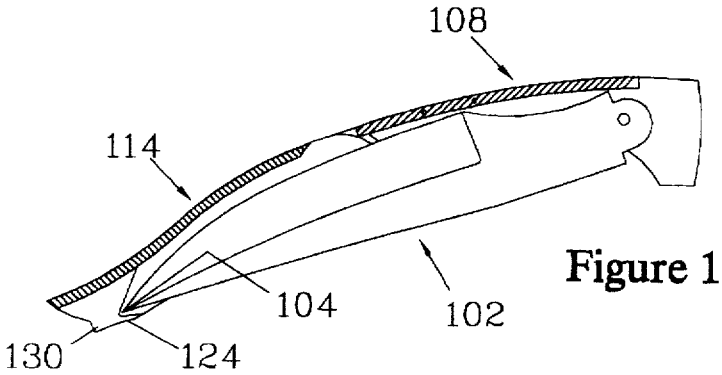
FIG. 16 is a section 16—16 of FIG. 13 illustrating the relative positions of the blade, the main handle and the tail handle in the storage configuration and showing how a tip engaging block maintains the blade in the storage configuration.

FIG. 16 is the section 16—16 of FIG. 13 where the folding knife 100 is in the storage configuration.

As is illustrated in FIG. 16, when the blade 102 is swung into the main groove 120 and the tail groove 122 (shown in FIG. 12), and the tail handle 114 is allowed to rotate toward the main handle 108 by a coil spring 134 (discussed in the description of FIGS. 17 and 18), the tip engaging block 124 will engage the blade tip 104, securing the blade 102 in the main groove 120 and the tail groove 122 (shown in FIG. 12). In the embodiment of FIGS. 11 through 18, the coil spring 134 (shown in FIGS. 17 and 18) serves as a biasing means where, in combination with the tip engaging block 124, it serves to secure the blade 102 in the storage configuration by engaging the blade tip 104 in the tip engaging block 124.

Figure 17:
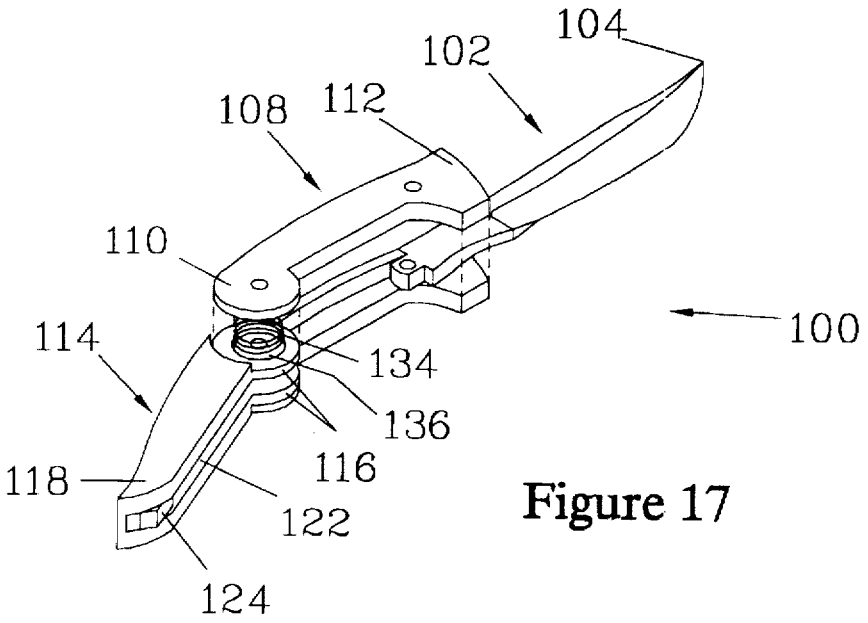
FIG. 17 is a partially exploded isometric view for an embodiment of a folding knife having the elements illustrated in FIGS. 11 through 16. In this embodiment, a coil spring is employed to bias the tail handle, which in turn is pivotably mounted to the butt end of the main handle, to pivot the tail handle towards the closed position with respect to the main handle. A tip engaging block is employed to maintain the blade in the tail groove and the main groove.

FIG. 17 shows a partially exploded isometric view of FIG. 15. In the embodiment illustrated in FIG. 17, the coil spring 134 is employed which will bias the tail handle 114 to rotate toward the closed position, where the free end 118 of the tail handle 114 engages the blade end 112 of the main handle 108 to form a grip. The coil spring 134 is mounted in a coil spring recess 136 in the butt engaging end 116 of the tail handle 114.

Figure 18:
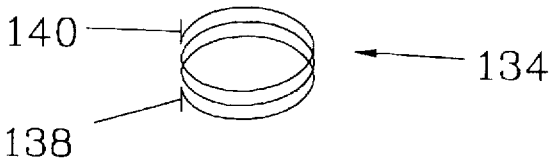
FIG. 18 is an isometric view of the coil spring illustrated in FIG. 17 and shows coil spring pins which engage the butt end of the main handle and the butt engaging end of the tail handle.

As shown in FIG. 18, the coil spring 134 has a butt engaging end pin 138 and a butt end pin 140. The butt engaging end pin 138 of the coil spring 134 engages a coil spring recess hole (not shown) in the butt engaging end 116 which is in the coil spring recess 136 shown in FIG. 17. The butt end pin 140 engages a butt end coil spring hole (not shown) in the butt end 110 of the main handle 108. It should be appreciated that the coil spring recess 136 could be located in the butt end 110 of the main handle 108.

Figure 19:
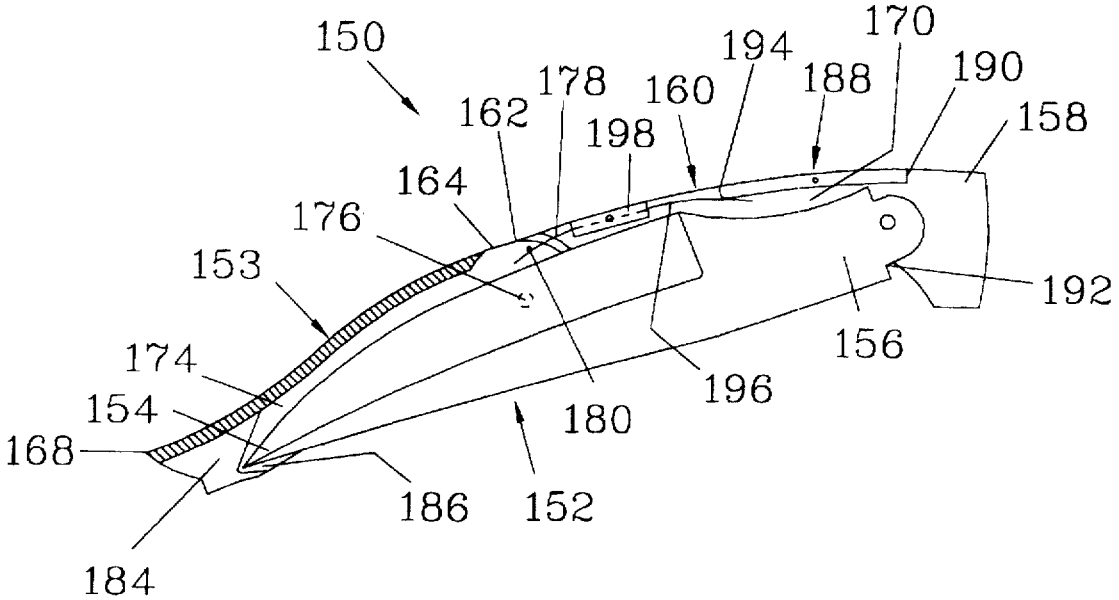
FIG. 19 illustrates another embodiment of the invention which is similar to the embodiment of FIGS. 11 through 17. The embodiment illustrated in FIG. 19 employs a tail-engaging leaf spring mounted in the main handle of the knife which engages a pin in the tail handle as the tail handle is rotated away from the main handle. The embodiment of FIG. 19 also employs a locking bar which engages an upper locking notch in the tang, which is provided to stabilize the blade in the work configuration. The locking bar is pivotably mounted in the main handle and biased by a locking bar leaf spring which is also mounted in the main handle.

FIG. 19 illustrates a folding knife 150 with a blade 152 which has an alternate biasing means which urge a tail handle 153 to move toward the closed position when in the open position to accept the blade 152. The blade 152 terminates in a tip 154 and a tang 156. The tang 156 is pivotably mounted to a blade end 158 of a main handle 160 of the folding knife 150. The main handle 160 has a butt end 162 which is pivotably mounted to a butt engaging end 164 of the tail handle 153. The tail handle 153 terminates in a free end 168.

The folding knife 150 is illustrated in the storage configuration with the blade 152 positioned in a main groove 170 in the main handle 160, and a tail groove 174, in the tail handle 153. The tail handle 153 pivots about a butt pivot axis 176. A biasing force is provided by a tail engaging leaf spring 178, which is mounted in the main handle 160, and which is engaged by a tail spring stop 180, mounted in the tail handle 153, as the tail handle 153 is rotated away from the main handle 160. The tail engaging leaf spring 178 will urge the tail handle 153 to move toward the closed position and, as it does so, the tip 154 of the blade 152 will engage a tip engaging block 184 which has a blade tip notch 186.

The embodiment of FIG. 19 also employs a locking bar 188 which is pivotably mounted in the main handle 160. The locking bar 188 has a first locking bar end 190 which engages an upper locking notch 192 when the blade 152 is in the work configuration. A second locking bar end 194 is engaged by a locking bar leaf spring 196. The locking bar leaf spring 196 and the tail engaging leaf spring 178 can be a common element, such as a wire or rod which passes through and is engaged by a spring retaining block 198, which in turn is mounted in the main handle 160.

Figure 20:
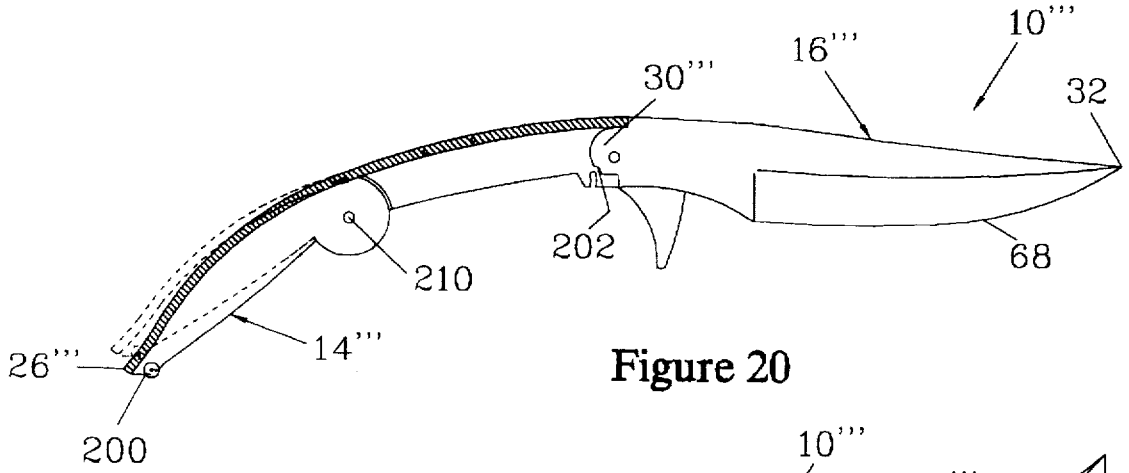
FIGS. 20 and 21 illustrate another embodiment of the present invention which is similar the embodiment illustrated in FIGS. 2 and 8. The embodiment of FIGS. 20 and 21 employs a grooved wheel mounted on the free end of the tail handle to serve as the tip encasing assembly. The grooved wheel is preferably fabricated from a sharpening stone so that the point and blade may be honed as the blade rolls through the groove of the wheel.

FIG. 20 illustrates the knife 10'" which is similar to the knife 10' illustrated in FIG. 8. In this embodiment, the tip engaging block 56 shown in FIG. 8, which served as the tip encasing assembly, has been eliminated and a grooved wheel 200 is rotatably mounted to the free end 26'" of the tail handle 14'". Preferably the grooved wheel 200 is a sharpening stone which can hone the blade tip 32 and the cutting edge 68 as it is traversed by the blade 16'". In the embodiment of FIG. 20, the wheel 200 also serves to help stabilize the blade 16'" when it is in the work configuration by engaging a wheel engaging notch 202 in the tang 30'".

Figure 21:
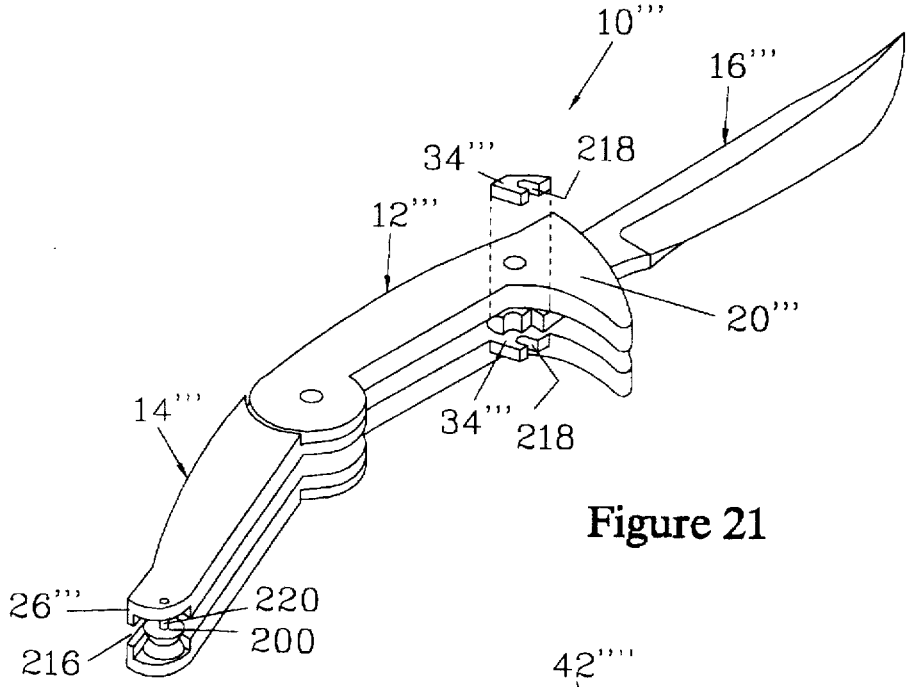

FIG. 21 is a partially exploded isometric view of the knife 10'" of FIG. 20 illustrating the spacial relationship between the mounting of the grooved wheel 200 and the free end 26'". The blade 16'" is pivotably mounted to the main handle 12'" while the grooved wheel 200 is mounted in the free end 26'" of the tail handle 14'". The free end 26'" is provided with a recess 216. This recess 216 allows ready access to the grooved wheel 200 so that it can be used to sharpen other knife blades by drawing them across the grooved wheel 200. The embodiment of FIGS. 20 and 21 also employs tabs 34'" in the blade end 20'" of the main handle 12'". The tabs 34'" are provided with slots 218 to accommodate an axle 220 on which the grooved wheel 200 is mounted.

Figure 22:
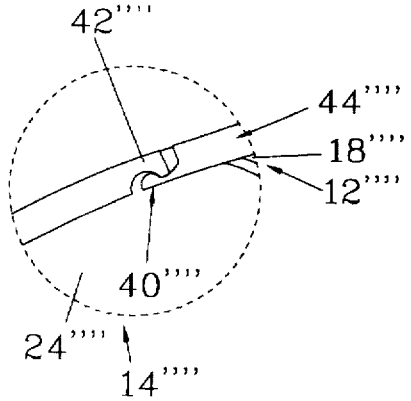
FIG. 22 is a detail view illustrating an alternative embodiment to that shown in the detail view of FIG. 10.

FIG. 22 shows a detailed view of an embodiment which is an alternative to the embodiment illustrated in FIGS. 2, 8, and 10. The detail view of FIG. 22 corresponds to the detail view of FIG. 10. In the alternative embodiment shown in FIG. 22, a cam 40"" is mounted to a leaf spring 44"" connected to a main handle 12"", while a cam follower 42"" is mounted to a butt engaging end 24"" of a tail handle 14"". The operation of the cam 40"" and the cam follower 42"" is essentially the same as the operation of the cam 40 and cam follower 42 illustrated in FIG. 10.

What I claim is:

1. A folding knife comprising:

a main handle having a blade end, a butt end and a main groove delimited by side surfaces and extending along said main handle, passing through said butt end and said blade end;

a tail handle having a butt engaging end pivotably attached to said butt end and a free end for engaging said blade end, said tail handle having a tail groove delimited by side surfaces and passing through said butt engaging end, wherein said side surfaces which delimit said tail groove are co-planar with said side surfaces which delimit said main groove, said tail handle pivoting between a closed position, where said free end engages said blade end whereby said tail handle and said main handle are in a work configuration, and at least one open position, wherein in one of said open positions, said main groove and said tail groove are aligned whereby said tail handle and said main handle are in a storage configuration;

a blade terminating in a tang and a blade tip, said tang being pivotably engaged to said blade end of said main handle, and said blade having said blade tip exposed when the knife is in said work configuration, and having said blade tip in said tail groove when said blade is engaged with said main groove and said tail groove in said storage configuration;

a biasing means for urging said tail handle, when in one of said open positions, to move toward said closed position; and a tip engaging encasing assembly positioned in said tail groove so as to engage said blade tip.

2. The folding knife of claim 1 wherein said tip encasing assembly further comprises:

a tip engaging block having a blade tip notch therein to accommodate said blade tip.

3. The folding knife of claim 2 wherein said folding knife further comprises:

a leaf spring residing in said main groove, said leaf spring engaging an upper tang notch in said tang of said blade when said blade is in said work configuration to stabilize said blade.

4. The folding knife of claim 3 wherein said blade has a cutting edge and the folding knife further comprises:

a spacer attached to said leaf spring, said spacer being positioned in said main handle so as to engage said tang when said blade is engaged with said main groove and said tail groove to prevent said cutting edge from contacting said main handle or said tail handle.

5. The folding knife of claim 2 further comprising:

an upper locking notch in said tang of said blade;

a locking bar pivotably mounted in said main handle, said locking bar having a first end and a second end, said first end engaging said upper locking notch when said blade is in said work configuration; and a leaf spring mounted in said main handle and resiliently engaged with said second end of said locking bar.

6. The folding knife of claim 1 wherein said tip encasing assembly further comprises:

a grooved wheel rotatably mounted in said tail groove and positioned such that said tail groove and said grooved wheel encase said blade tip when said blade is engaged with said main groove and said tail groove.

7. The folding knife of claim 6 wherein said grooved wheel is a sharpening stone.

8. The folding knife of claim 6 wherein said folding knife further comprises:

a leaf spring residing in said main groove, said leaf spring engaging an upper tang notch in said tang of said blade when said blade is in said work configuration to stabilize said blade.

9. The folding knife of claim 1 wherein said biasing means for urging said tail handle, when in one of said open positions, to move toward said closed position comprises:

a coil spring engaging said butt end of said main handle and said butt engaging end of said tail handle.

10. The folding knife of claim 9 wherein said blade end has tabs and said free end has tab receiving recesses.

11. The folding knife of claim 1 wherein said biasing means for urging said tail handle, when in one of said open positions, to move toward said closed position comprises:

a tail engaging leaf spring mounted on said main handle; and a tail spring stop mounted in said tail handle positioned to engage said tail engaging leaf spring as said tail handle is rotated into said one open position.

12. The folding knife of claim 11 wherein said tail engaging leaf spring is provided by a wire mounted in a spring retaining block, said spring retaining block being mounted in said main handle.

13. The folding knife of claim 1 wherein said biasing means for urging said handle, when in one of said open positions, to move toward said closed position comprises:

a cam, having a cam surface, said cam being mounted on said tail handle;

a cam follower mounted on said main handle; and a leaf spring residing in said main groove, said leaf spring being attached to said cam follower for biasing said cam follower toward said cam surface.

14. The folding knife of claim 1 wherein said biasing means for urging said tail handle, when in one of said open positions, to move toward said closed position comprises:

a cam, having a cam surface, said cam being mounted on said main handle;

a cam follower mounted on said tail handle; and a leaf spring residing in said main groove, said leaf spring being attached to said cam for biasing said cam toward said cam follower.

15. The folding knife of claim 1 wherein said blade end has tabs and said free end has tab receiving recesses.

16. A folding knife comprising:

a main handle having a blade end, a butt end, and a main groove delimited by side surfaces and extending along said main handle, passing through said butt end and said blade end;

a tail handle having a butt engaging end pivotably attached to said butt end and a free end for engaging said blade end, said tail handle having a tail groove delimited by side surfaces and passing through said butt engaging end, said side surfaces which delimit said tail groove being co-planar with said side surfaces which delimit said main groove, said tail handle pivoting between a closed position, where said free end engages said blade end, and at least one open position;

a blade having a tang and a blade tip, said tang being pivotably engaged to said blade end of said main handle, allowing said blade to rotate between a work configuration, where said tail handle is in the closed position and said tip is exposed, and a storage configuration, where said tail handle is in one of said open positions and said blade engages said main groove and said tail groove such that said blade tip resides in said tail groove;

a biasing means for urging said tail handle, when in one of said open positions, to move toward said closed position; and a tip encasing assembly positioned in said tail groove so as to engage said blade tip.

17. The folding knife of claim 16 wherein said biasing means for urging said tail handle, when in one of said open positions, to move toward said closed position comprises:

a cam having a cam surface;

a cam follower; and a leaf spring attached to said cam follower for resiliently engaging said cam follower with said cam surface;

said leaf spring residing in said main groove and further engaging an upper tang notch in said tang of said blade when said blade is in said work configuration to stabilize said blade.

18. The folding knife of claim 17 wherein said cam is attached to said butt engaging end.

19. The folding knife of claim 18 wherein said blade end has tabs and said free end has tab receiving recesses.

* * * * *